US005537825A

United States Patent [19]

Ward

[11] Patent Number: 5,537,825

[45] Date of Patent: Jul. 23, 1996

[54] DRAFT BEER TOWER COOLING SYSTEM

[76] Inventor: Justin Ward, 742 Foxwood Dr., Oceanside, Calif. 92057

[21] Appl. No.: 364,716

[22] Filed: Dec. 27, 1994

[51] Int. Cl.[6] ..... B67D 5/62; F25B 21/02

[52] U.S. Cl. ..... 62/3.64; 62/393; 222/146.6

[58] Field of Search ..... 62/3.64, 3.2, 3.7, 62/389, 393; 222/146.6

[56] References Cited

U.S. PATENT DOCUMENTS

| | | | |
|---|---|---|---|
| 2,162,842 | 6/1939 | Dolison et al. | 62/393 |
| 2,262,043 | 11/1941 | Perlick | 62/393 |
| 3,790,032 | 2/1974 | George | 222/146.6 X |
| 4,320,626 | 3/1982 | Donnelly | 62/3.64 |
| 4,674,296 | 6/1987 | Renaud | 62/389 |

FOREIGN PATENT DOCUMENTS

| | | | |
|---|---|---|---|
| 139393 | 5/1990 | Japan | 222/146.6 |

*Primary Examiner*—Henry A. Bennett
*Assistant Examiner*—William C. Doerrler
*Attorney, Agent, or Firm*—Charles C. Logan, II

[57] ABSTRACT

A draft beer tower cooling system having an adapter collar that is removably attached to the top end of a draft beer tower. The adapter collar has a centrally located bore hole that extends from its top surface to its bottom surface and a thermoelectric cooler module is mounted therein. The bottom surface of the thermoelectric cooler module is in contact with a cold plate having a plurality of metal cables dangling from its bottom surface. A heat sink is positioned in contact with the top surface of the thermoelectric cooler module and an exhaust fan unit is mounted to the top of the heat sink. The thermoelectric cooler module functions to transfer heat from the interior of the draft beer tower to the heat sink where the exhaust fan unit dissipates the heat into the surrounding atmosphere.

7 Claims, 1 Drawing Sheet

DRAFT BEER TOWER COOLING SYSTEM

BACKGROUND OF THE INVENTION

The invention relates to a cooling and dispensing system and more specifically one that would be installed in a draft beer tower having a conventional beer tap faucet.

Beer needs to be kept at 39 degrees in order to prevent foam from coming out of the draft beer tap faucet. The kegs in which draft beer is stored can easily be kept at 39 degrees with existing cooling systems. A major problem is keeping the draft beer in the beer line and the tower at 39 degrees. When draft beer reaches 42 degrees, too much foam forms and at 52 degrees it is almost all foam. The longer the beer line, the greater is the problem in keeping the beer at the correct temperature before exiting the spout.

Several patents have been granted for structures utilized in keeping the beer in a beer line adequately cold. The Daun U.S. Pat. No. 2,638,758 discloses a novel refrigerated tap rod. The Redlin U.S. Pat. No. 2,675,822 discloses a beer dispensing system capable of dispensing beer into a glass with the beer holding its carbonization by adding a head of foam on the top of the drawn beer. The foam acts to seal off the beer and retain the carbonization and flavor brewed into the beer.

The Thompson U.S. Pat. No. 3,865,276 discloses a portable keg tapper having a portable ice container adapted to be supported on the top of the keg. The Bevin U.S. Pat. No. 4,094,445 discloses a high speed beer dispensing method that provides the proper temperature to prevent excessive foam when it is being dispensed. The Lamont et al U.S. Pat. No. 4,676,400 discloses a liquid dispensing system that permits the use of water as a coolant and utilizes parasitic cooling from a walk-in cooler. The Burton U.S. Pat. No. 4,901,887 discloses a beverage dispensing system having a tower mounted on the top of the refrigerator. The Hassell et al U.S. Pat. No. 5,249,710 is directed to a beverage dispenser having a cold plate with evaporative cooling.

It is an object of the invention to provide a novel draft beer tower cooling system that can be easily and quickly installed in the tower of a beer tap faucet.

It is also an object of the invention to provide a novel draft beer tower cooling system that will maintain the temperature of beer being dispensed from the tower beer tap faucet at 39 degrees or less.

It is another object of the invention to provide a novel draft beer tower cooling system that is economical to manufacture and market.

It is an additional object of the invention to provide a novel draft beer tower cooling system that can be retro-fit to existing draft beer towers.

SUMMARY OF THE INVENTION

The novel draft beer tower cooling system is easily and quickly installed. The cap on an existing draft beer tower is removed and the inventor's novel system installed. It has an adapter collar that fits down over the top of the draft beer tower.

Mounted on the bottom surface of the adapter collar is a cold plate having the top ends of a plurality of elongated metal cables connected thereto. The elongated metal cables extend downwardly substantially the entire height of the tower. These cables are flexible so that they can be bent during insertion into the tower and positioning around the existing beer line.

The adapter collar is made of insulated material such as plastic and it has a centrally located bore hole within is mounted a thermoelectric cooler module (TEC). The TEC module is a bi-metallic conductor that is connected to a d.c. source of electric power such as a d.c. converter. Its bottom side absorbs heat and its top side expels heat. There is a heat sink mounted on the top surface of the TEC module and it absorbs the heat and the exhaust fan unit exhausts the heat away. A thermostat would be mounted in the interior of the beer tower and connected to the electrical wires of the cooling system so that the interior of the tower can be maintained at 39 degrees.

DESCRIPTION OF THE PREFERRED EMBODIMENT

Figure 1:
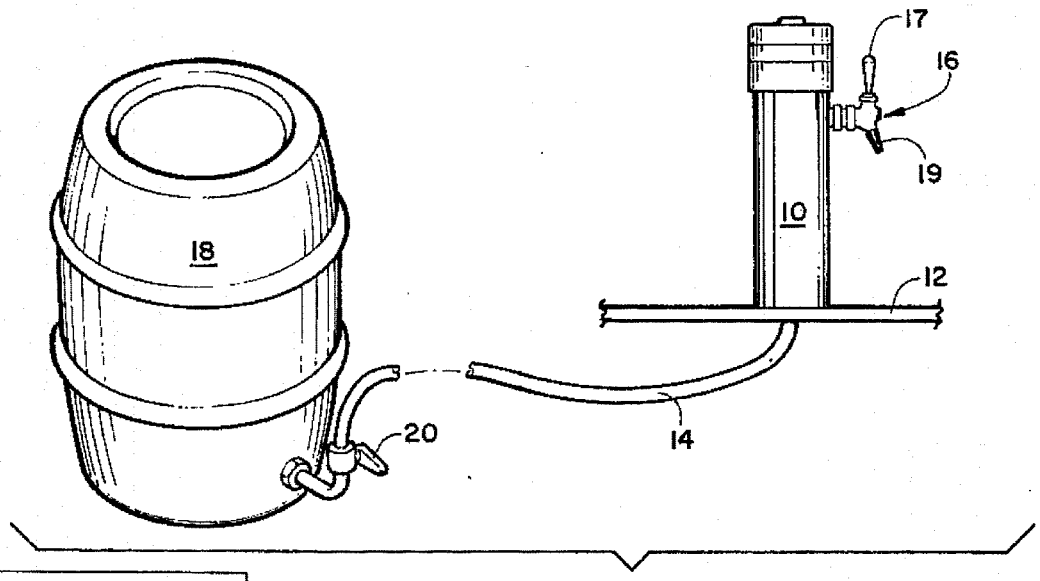
FIG. 1 is a perspective view illustrating the novel draft beer tower cooling system mounted on a draft beer tower that is connected to a beer keg.

The novel draft beer tower cooling system will now be described by referring to FIGS. 1 and 2 of the drawing. Draft beer tower 10 is shown mounted on a counter top 12. A beer line 14 has its one end connected to beer tap faucet 16. The other end of beer line 14 is connected to beer keg 18 and it has a valve 20 for shutting off its flow.

Figure 2:
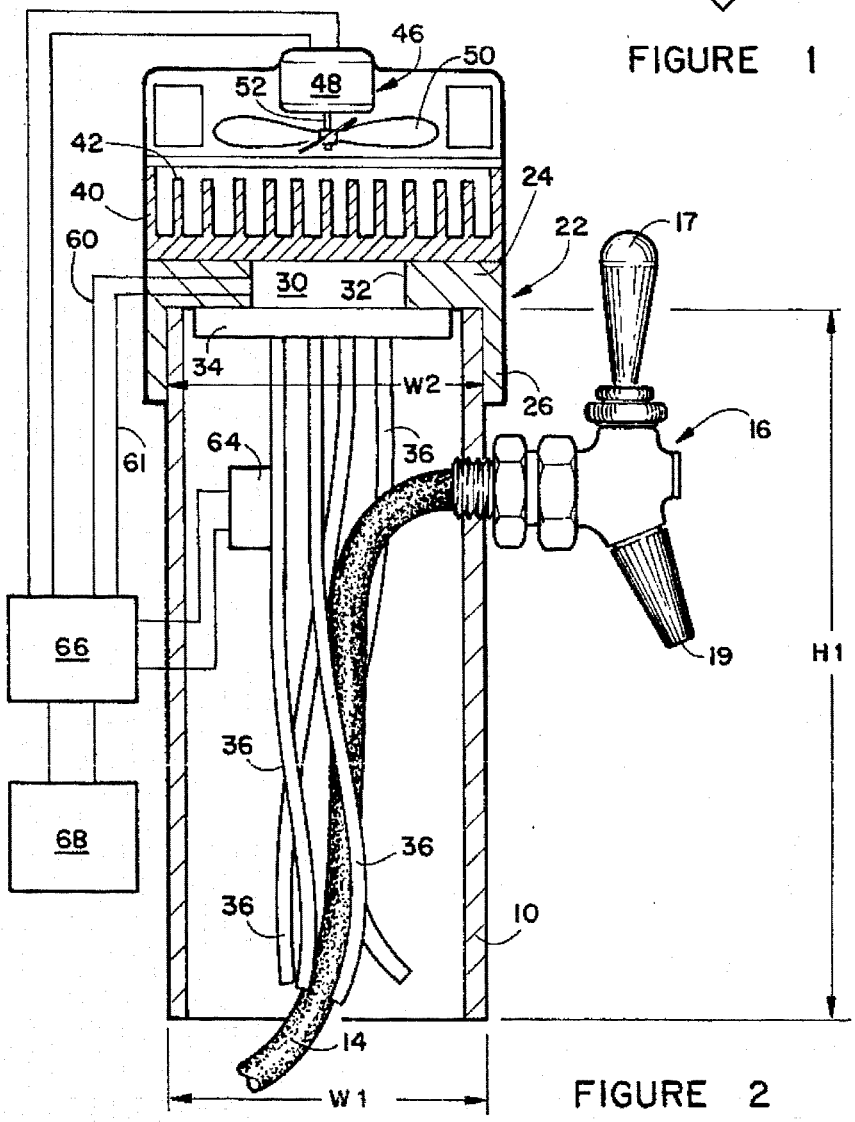
FIG. 2 is a side elevation view in cross section showing the draft beer tower cooling system mounted in the beer tower.

FIG. 2 illustrates the draft beer tower cooling system that is removably mounted in the draft beer tower 10. An adapter collar 22 made of an insulating material such as plastic is removably secured to the top end of draft beer tower 10. Adapter collar 22 has a circular disc member 24 having an annular flange 26 extending downwardly from the periphery of its bottom surface. A thermoelectric cooler module (TEC) 30 is mounted in bore hole 32. A cold plate 34 has its top surface in contact with the thermoelectric cooler module 30. A plurality of cables 36 have their top ends secured to the bottom surface of cold plate 34. These cable members have a length L1. They function to conduct heat from the interior of the draft beer tower 10 to the bottom surface of the thermoelectric cooler module 30.

The top surface of thermoelectric cooler module 30 is connected to heat sink 40 that has a plurality of fins 42 extending upwardly from its top surface. An exhaust fan unit 46 is mounted on the top of heat sink 40. It has a motor 48 and a plurality of blades 50 mounted on a shaft 52.

Thermoelectric cooler module 30 is connected by electrical wires 60 and 61 to d.c. converter 66 and an a.c. power source 68. A thermostat 64 is connected to d.c. converter 66.

The draft beer tower 10 has a height H1 and has an outer width W1. Adapter collar 22 has a width W2 and an interior recess on its bottom end that is only slightly larger in diameter than W1 so that it can be removably positioned thereon. Beer tap faucet 16 has a handle 17 and a spout 19.

The manner in which the draft beer tower cooling system operates will now be explained. Heat from the interior of draft beer tower 10 is transferred by conductance to the outer surface of the plurality of metal cables 36 and then to the bottom surface of metal cold plate 34. Thermoelectric cooler module 30 receives this heat on its bottom surface and by absorbing it the interior of the draft beer tower 10 is cooled. This heat is then transferred from the top surface of the thermoelectric cooler module to heat sink 40. A plurality of fins 42 on the top surface of heat sink 40 aid in dissipating the heat that is being removed from the draft beer tower and exhaust fan unit 46 accelerates this process. Thermoelectric cooler module 30 is connected by electrical conductor wires 60 and 61 to d.c. converter 66 that is in turn connected to a.c. power source 68. Thermostat 64 monitors the interior temperature of the draft beer tower 10. An a.c. power source is not necessary when a d.c. power source is available.

What is claimed is:

1. A draft beer tower cooling system comprising:

an adapter collar that can be removably mounted on the top of a draft beer tower; said adapter collar being made of insulating material; said adapter collar having a centrally located bore hole extending from its top surface to its bottom surface;

a thermoelectric cooler module having a top surface and a bottom surface; said thermoelectric cooler module functions to transfer heat from its bottom surface to its top surface; said thermoelectric cooler module being mounted in the bore hole of said adapter collar;

a cold plate having a top surface and a bottom surface; the top surface of said cold plate being in heat transferring contact with the bottom surface of said thermoelectric cooler module for absorbing heat in a draft beer tower;

at least one upright oriented elongated flexible metal cable having a top end, a bottom end and a predetermined length; the top end of said flexible metal cable being connected in heat transferring contact with the bottom surface of said cold plate; said flexible metal cable extending downwardly from the bottom surface of said cold plate;

a heat sink having a top surface and a bottom surface; the bottom surface of said heat sink being in heat transferring contact with the top surface of said thermoelectric module; and an exhaust fan mounted above the top surface of said heat sink.

2. A draft beer tower cooler system as recited in claim 1 in combination with a draft beer tower having a top end and having a height H1, said adapter collar being removably secured to the top end of said draft beer tower; and said flexible metal cable having a length substantially equal to H1.

3. A draft beer tower cooling system as recited in claim 1 wherein said heat sink has a plurality of fins extending upwardly from its top surface.

4. A draft beer tower cooling system as recited in claim 1 wherein said adapter collar has a circular disc member having a peripheral edge.

5. A draft beer tower cooling system as recited in claim 4 further comprising an annular flange extending downwardly from the peripheral edge of said circular disc member.

6. A draft beer tower cooling system as recited in claim 1 wherein said thermoelectric cooler module has a pair of electrical wires connected to it and these wires are connected to a source of d.c. power.

7. A draft beer tower cooling system as recited in claim 6 further comprising a pair of electrical wires connected to a thermostat that would be positioned inside a draft beer tower.

* * * * *